US011879461B2

(12) United States Patent
Sakai et al.

(10) Patent No.: US 11,879,461 B2
(45) Date of Patent: Jan. 23, 2024

(54) OIL PUMP WITH STRAIGHTENING MEMBER BRANCHING THE SUCTION PASSAGE

(71) Applicant: TOYODA GOSEI CO., LTD., Kiyosu (JP)

(72) Inventors: Shinya Sakai, Kiyosu (JP); Mitsuhiro Yoshimura, Kiyosu (JP); Jang Myong Hwan, Nagoya (JP); Shoma Suzuki, Kiyosu (JP)

(73) Assignee: TOYODA GOSEI CO., LTD., Aichi-pref. (JP)

( * ) Notice: Subject to any disclaimer, the term of this patent is extended or adjusted under 35 U.S.C. 154(b) by 0 days.

(21) Appl. No.: 17/742,739

(22) Filed: May 12, 2022

(65) Prior Publication Data

US 2022/0381240 A1 Dec. 1, 2022

(30) Foreign Application Priority Data

May 27, 2021 (JP) ..... 2021-089642

(51) Int. Cl.

*F04C 2/10* (2006.01)
*F04C 2/08* (2006.01)
*F04C 15/06* (2006.01)

(52) U.S. Cl.

CPC ..... *F04C 2/102* (2013.01); *F04C 2/086* (2013.01); *F04C 15/06* (2013.01); *F04C 2210/206* (2013.01); *F04C 2240/30* (2013.01); *F04C 2250/10* (2013.01); *F04C 2250/101* (2013.01)

(58) Field of Classification Search

CPC ..... F04C 2/102; F04C 2/086; F04C 15/06; F04C 2210/206; F04C 2240/30; F04C 2250/10; F04C 2250/101

See application file for complete search history.

(56) References Cited

U.S. PATENT DOCUMENTS 9,657,734 B2 * 5/2017 Holtzapple ..... F01C 19/02

FOREIGN PATENT DOCUMENTS

| | | | |
|---|---|---|---|
| JP | H02-043480 | U | 3/1990 |
| JP | H11-270472 | A | 10/1991 |
| JP | H05-038372 | U | 5/1993 |
| JP | 2017-166372 | A | 9/2017 |

OTHER PUBLICATIONS

Office Action dated Dec. 5, 2023 in connection with counterpart Japanese Patent Application No. 2021-089642 (and English translation).

* cited by examiner

*Primary Examiner* — Mary Davis
(74) *Attorney, Agent, or Firm* — POSZ LAW GROUP, PLC

(57) ABSTRACT

An oil pump includes: a shaft member; an inner rotor configured to rotate integrally with the shaft member; an outer rotor forming a rotor chamber into which oil is sucked from a suction passage and from which the oil is discharged toward a discharge passage, between the inner rotor and the outer rotor; a body member having a recess-shaped housing chamber in which each rotor is housed so as to be rotatable about an axis; and a cover member attached so as to close the housing chamber. The rotor chamber has first and second suction ports through each of which the oil to be sucked from the suction passage passes. The oil pump includes a straightening member branching the suction passage from a main path to the first suction port side and the second suction port side.

7 Claims, 7 Drawing Sheets

OIL PUMP WITH STRAIGHTENING MEMBER BRANCHING THE SUCTION PASSAGE

TECHNICAL FIELD

The present invention relates to an oil pump.

BACKGROUND ART

Hitherto, an oil pump that is mounted on a vehicle has been known (for example, JP2017-166372(A)). The oil pump described in JP2017-166372(A) is driven by an engine of a vehicle, sucks oil from an oil pan, and supplies the oil to a drive system such as a transmission. The oil pump includes a shaft member which rotates by engine drive, an inner rotor which rotates integrally with the shaft member, and an outer rotor which meshes with the inner rotor in a state where the outer rotor is eccentric to the inner rotor. The inner rotor has a plurality of external teeth. The outer rotor is disposed on the outer peripheral side of the inner rotor, meshes with the inner rotor in a state where the outer rotor is eccentric to the inner rotor, and has a plurality of internal teeth, the number of which is different from that of the external teeth of the inner rotor. The inner rotor and the outer rotor are housed in a recess-shaped housing chamber, which is formed in a body member, so as to be rotatable about an axis. The housing chamber of the body member is closed by a cover member attached to the body member.

In the above oil pump, when the engine is driven, the shaft member and the inner rotor rotate integrally with each other, and the outer rotor rotates in a state where the outer rotor is eccentric to the inner rotor. When such rotation occurs, the volumes of a plurality of rotor chambers formed between the inner rotor and the outer rotor are changed sequentially by repeating reduction and expansion of the rotor chambers, whereby the oil is sucked up from a storage portion to the rotor chambers due to negative pressure action and is pressure-fed from the rotor chambers to the drive system due to compression action.

Moreover, in the above oil pump, each rotor chamber has two suction ports. The two suction ports are provided at both ends in the axial direction of the rotor chamber so as to be opposed to each other in the axial direction. Branch passages branched from a suction passage communicate with the respective suction ports, and the oil that has entered the branch passages from the suction passage is guided to the respective suction ports.

SUMMARY OF INVENTION

Technical Problem

In the above oil pump described in JP2017-166372(A), however, the flow of the oil branched from the suction passage and guided to each suction port is not straightened, so that the flow rate of the oil guided to the rotor chamber may become ununiform in that the flow rate of the oil via one suction port side is higher. When such ununiformity occurs, a difference is produced between the flow velocities of the oil introduced through the two suction ports, so that cavitation (air bubbles) which causes erosion is likely to occur.

The present invention has been made in view of such a problem, and an object of the present invention is to provide an oil pump capable of suppressing occurrence of cavitation by making it difficult to make a flow rate of oil to be ununiform in that the flow rate of the oil is higher in one of two suction ports.

Solution to Problem

An aspect of the present invention is directed to an oil pump including: a shaft member configured to rotate by drive of a drive source; an inner rotor having external teeth and configured to rotate integrally with the shaft member; an outer rotor having internal teeth meshing with the external teeth, configured to rotate as the inner rotor rotates, and forming a rotor chamber into which oil is sucked from a suction passage and from which the oil is discharged toward a discharge passage, between the inner rotor and the outer rotor; a body member having a recess-shaped housing chamber in which the inner rotor and the outer rotor are housed so as to be rotatable about an axis; and a cover member having at least a part of the suction passage and attached so as to close the housing chamber, wherein the rotor chamber has a first suction port and a second suction port through each of which the oil to be sucked from the suction passage into the rotor chamber passes, and the oil pump includes a straightening member branching the suction passage from a main path to the first suction port side and the second suction port side, and configured to straighten the oil guided from the main path to the first suction port and the oil guided from the main path to the second suction port.

With this configuration, it is possible to avoid a situation in which the flow rate of the oil guided from the suction passage to the rotor chamber is ununiform in that the flow rate of the oil via one suction port side out of the two suction ports is higher. Therefore, it is possible to make it difficult to make the flow rate of the oil to be ununiform in that the flow rate of the oil is higher in one of the two suction ports, thereby suppressing occurrence of cavitation.

DESCRIPTION OF EMBODIMENTS

A specific embodiment of the oil pump according to the present invention will be described with reference to FIG. 1 to FIG. 11.

An oil pump 1 according to an embodiment is a trochoid type internal gear pump which pressure-feeds oil sucked from a suction port, to a discharge port. The oil pump 1 is mounted, for example, on a vehicle or the like, and supplies oil to a drive system, such as a transmission, and the like for cooling or lubrication. The oil pump 1 is formed in a block shape as a whole as shown in FIG. 1 to FIG. 4.

Figure 1:
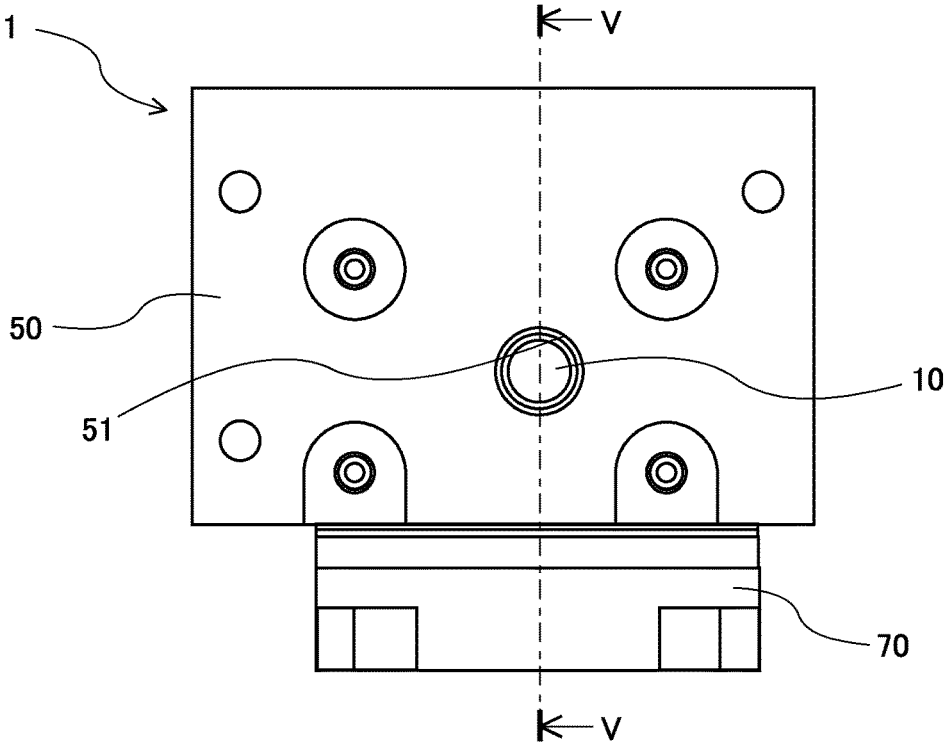
FIG. 1 is a front view of an oil pump according to an embodiment.
Figure 2:
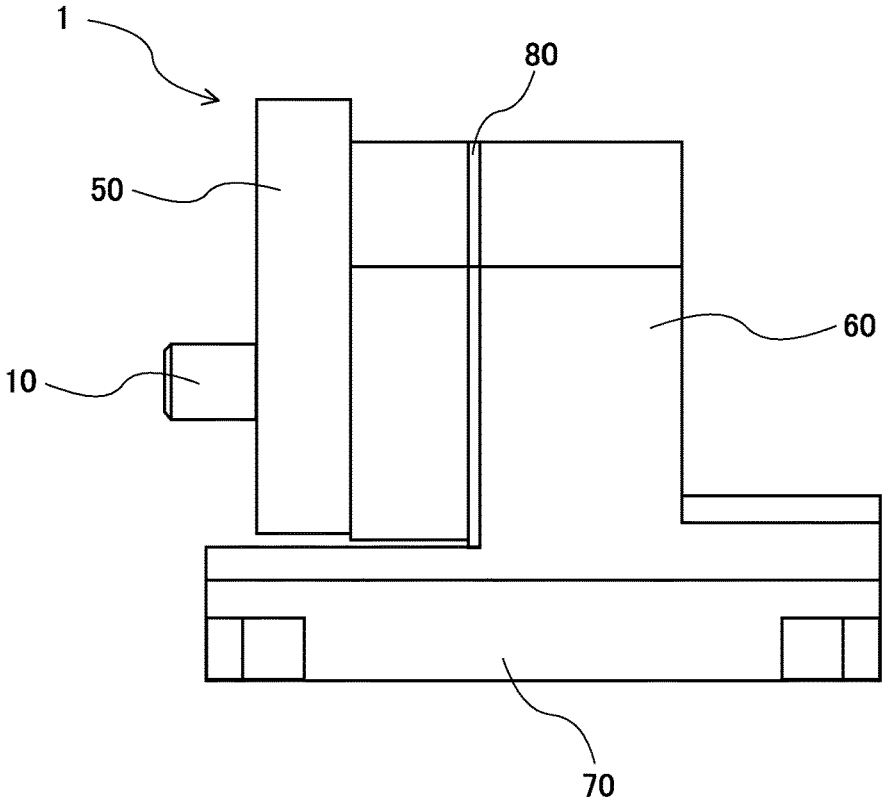
FIG. 2 is a side view of the oil pump according to the embodiment.
Figure 3:
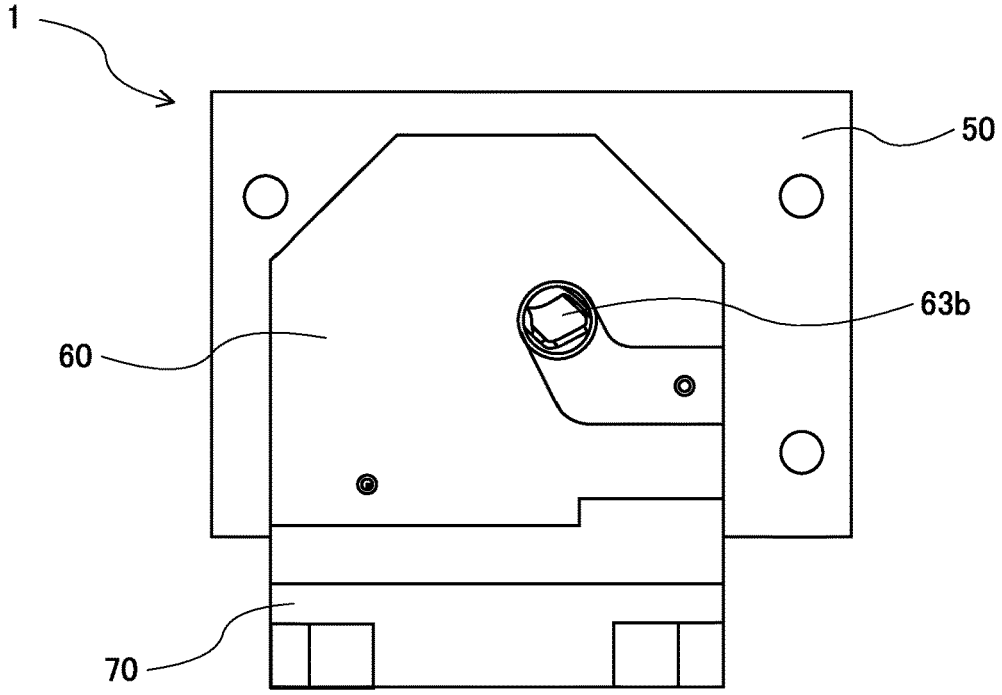
FIG. 3 is a back view of the oil pump according to the embodiment.
Figure 4:
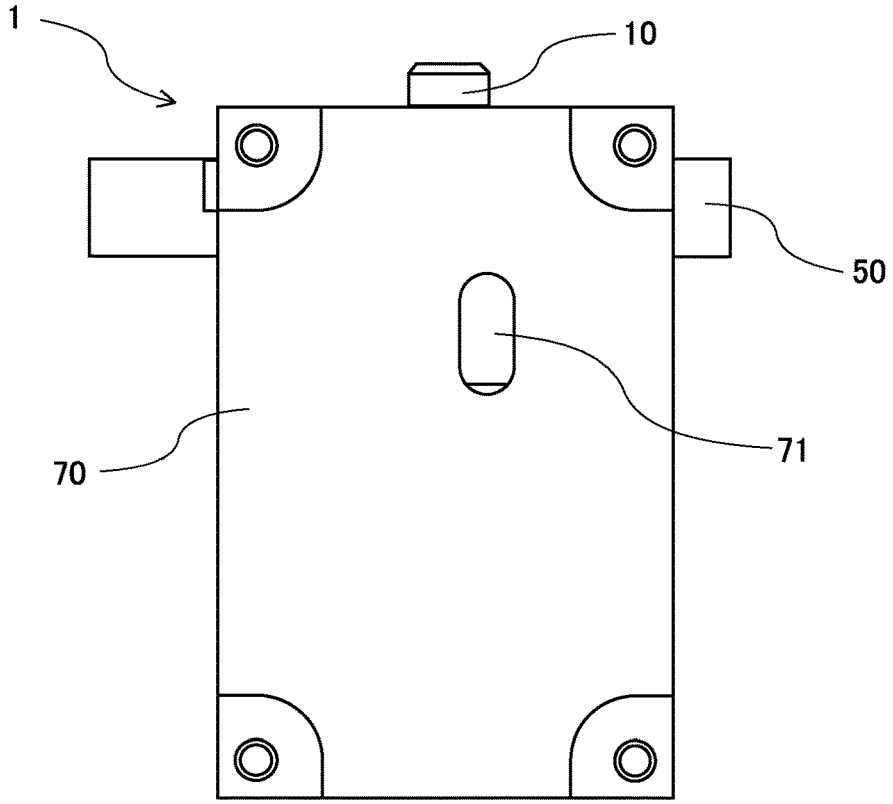
FIG. 4 is a bottom view of the oil pump according to the embodiment.
Figure 5:
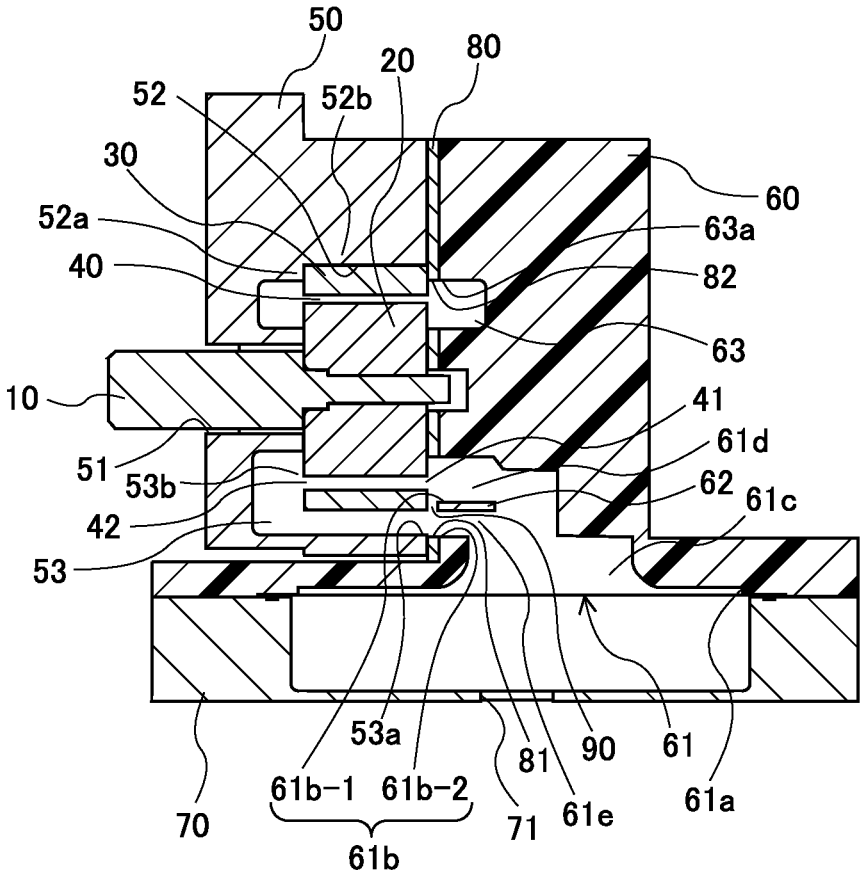
FIG. 5 is a cross-sectional view of the oil pump according to the embodiment taken along a straight line V-V shown in FIG. 1.
Figure 6:
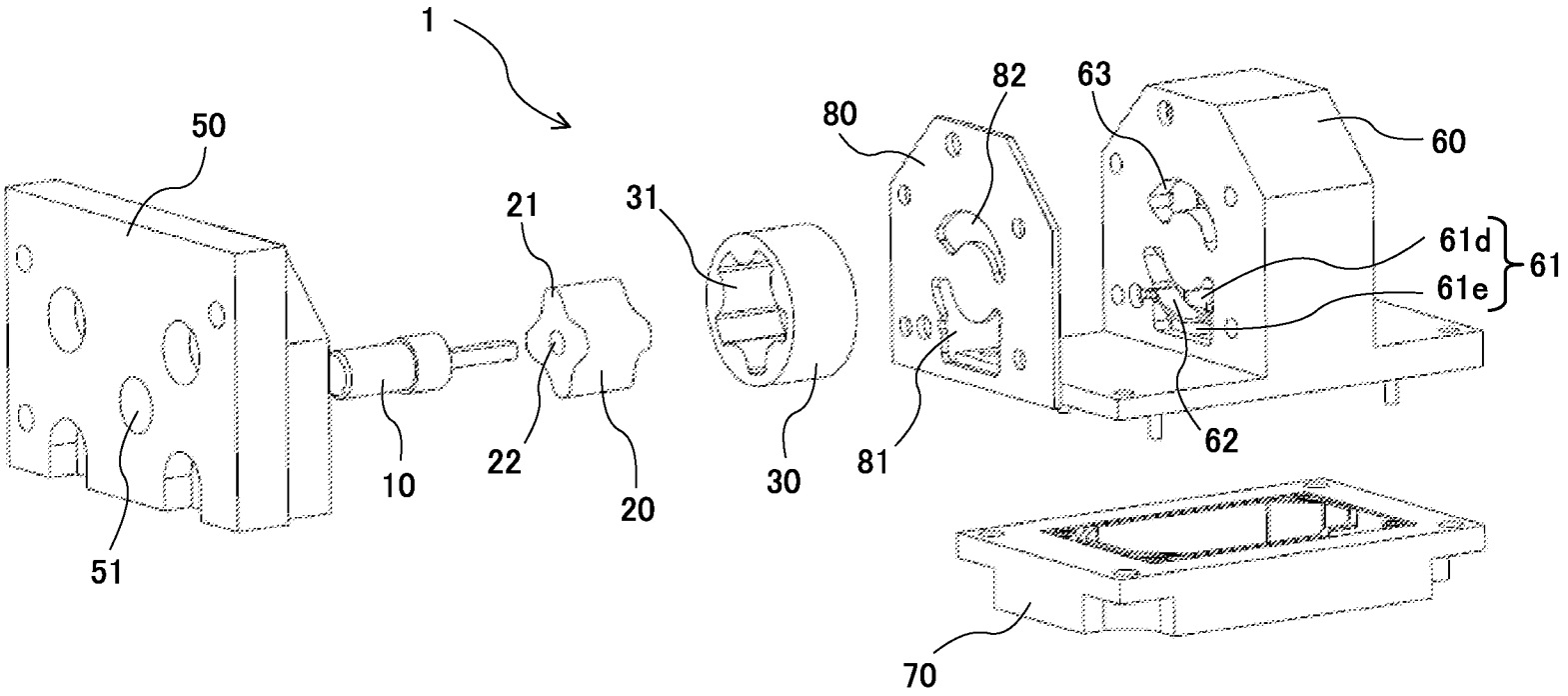
FIG. 6 is an exploded perspective view of the oil pump according to the embodiment as viewed from the front side.
Figure 7:
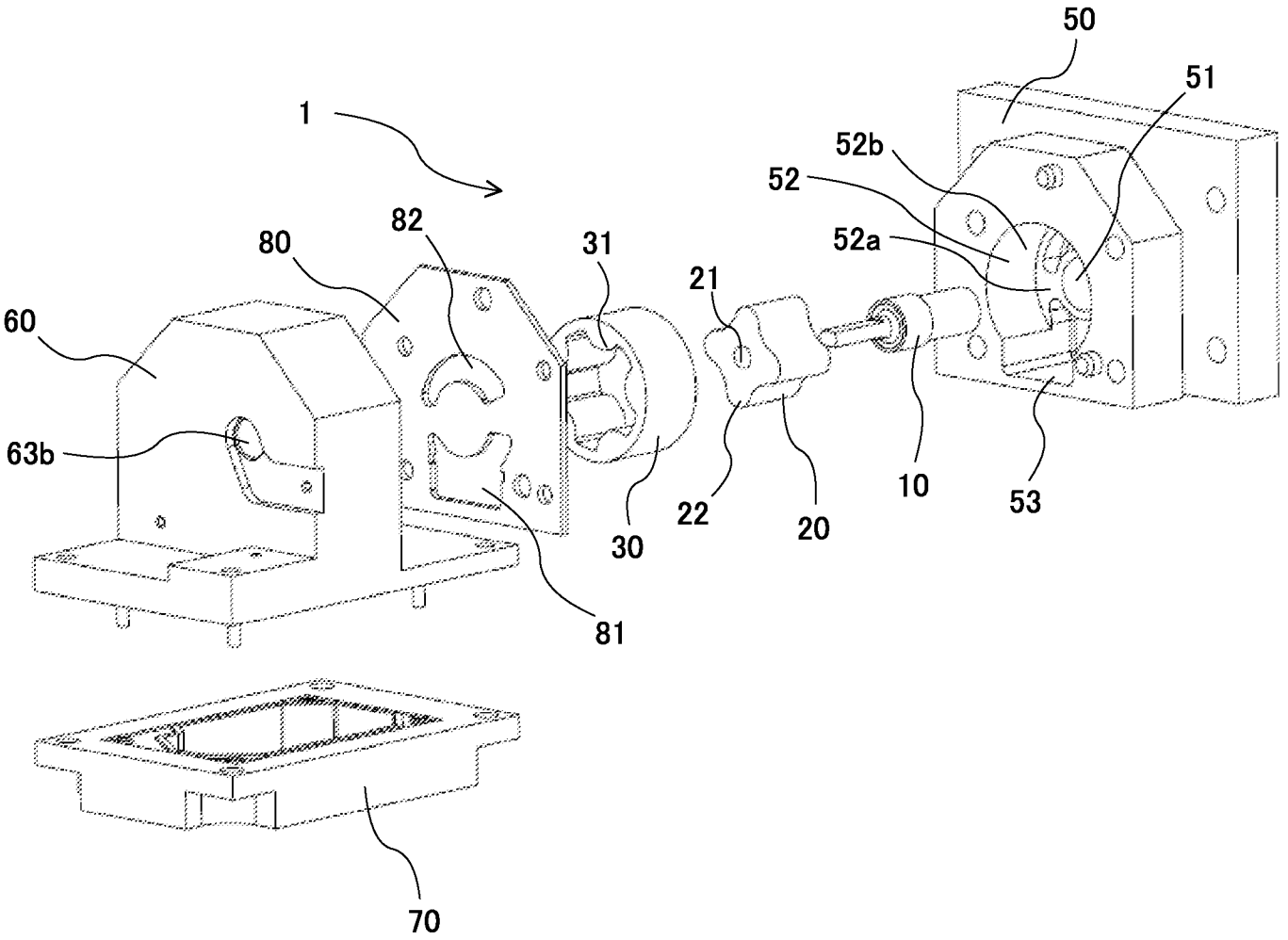
FIG. 7 is an exploded perspective view of the oil pump according to the embodiment as viewed from the back side.

As shown in FIG. 5 to FIG. 7, the oil pump 1 includes a shaft member 10, an inner rotor 20, and an outer rotor 30. The shaft member 10 is a shaft member which rotates by drive of a drive source such as a vehicle engine. The shaft member 10 extends in a rod shape in an axial direction. The inner rotor 20 and the outer rotor 30 are rotary bodies forming a trochoid pump. Each of the inner rotor 20 and the outer rotor 30 is formed from a sintered metal (for example, an iron-based metal, a copper-iron-based metal, a copper-based metal, a stainless-based metal, etc.).

The inner rotor 20 is a disc-shaped or columnar member having a plurality of external teeth 21. The external teeth 21 are provided on the outer circumferential surface of the inner rotor 20 at equiangular intervals. The number of the external teeth 21 in the inner rotor 20 is a predetermined number (for example, four). The inner rotor 20 has a shaft hole 22 which penetrates the inner rotor 20, at the center thereof. The inner rotor 20 is supported and fixed to the shaft member 10 at the center thereof by inserting the shaft member 10 into the shaft hole 22. The shaft member 10 is rotatably supported on a body member 50 described later, via a bearing (not shown). The inner rotor 20 rotates integrally with the shaft member 10.

The outer rotor 30 is an annular or cylindrical member having a plurality of internal teeth 31. The internal teeth 31 are provided on the inner peripheral surface of the outer rotor 30 at equiangular intervals. The number of the internal teeth 31 in the outer rotor 30 is a predetermined number (for example, five) that is larger than the number of the external teeth 21 in the inner rotor 20 by a predetermined number (for example, one).

The outer rotor 30 has an inner space in which the inner rotor 20 can be housed. The outer rotor 30 is disposed on the outer peripheral side of the inner rotor 20. The internal teeth 31 of the outer rotor 30 mesh with the external teeth 21 of the inner rotor 20. The inner rotor 20 and the outer rotor 30 are eccentric to each other. That is, the axial center of the inner rotor 20 and the axial center of the outer rotor 30 are provided at positions displaced relative to each other. The inner rotor 20 and the outer rotor 30 are rotatable relative to each other in a state where the inner rotor 20 and the outer rotor 30 are eccentric to each other. The outer rotor 30 rotates as the inner rotor 20 rotates.

Figure 10:
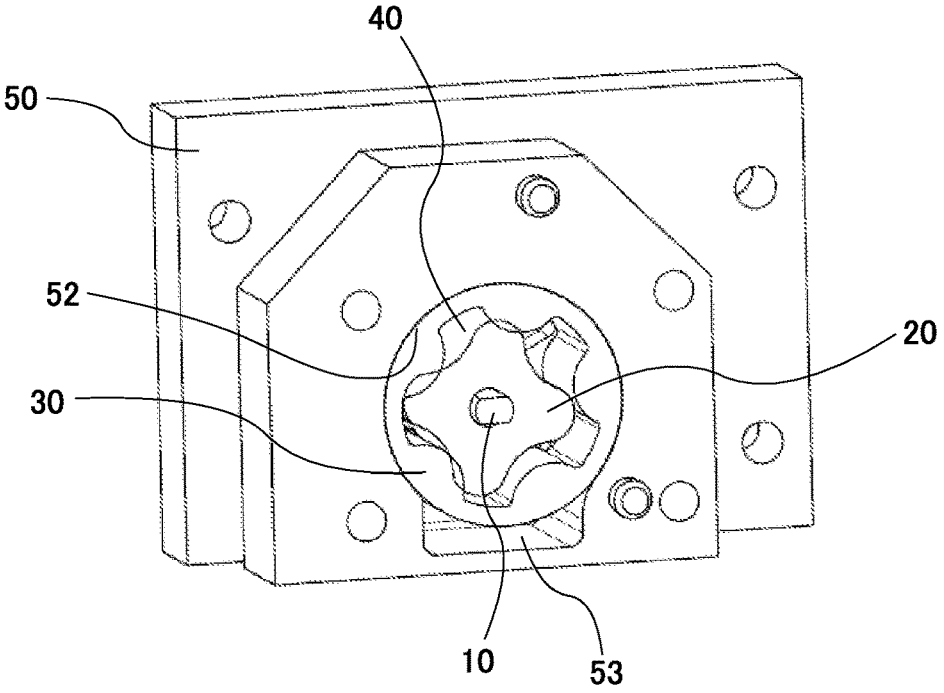
FIG. 10 is a perspective view showing a state where an inner rotor and an outer rotor are housed in a housing chamber of the body member included in the oil pump according to the embodiment.

As shown in FIG. 5 and FIG. 10, the inner rotor 20 and the outer rotor 30 form a plurality of rotor chambers 40 surrounded by the outer circumferential surface of the inner rotor 20 and the inner peripheral surface of the outer rotor 30. The rotor chambers 40 are spaces for sucking the oil from a suction passage of the oil pump 1 and discharging the oil toward a discharge passage. The volume of each rotor chamber 40 is changed sequentially by repeating reduction and expansion of the rotor chamber 40 as the inner rotor 20 and the outer rotor 30 rotate.

The oil pump 1 also includes the body member 50, a cover member 60, a strainer 70, and a plate member 80.

The body member 50 is a member in which the inner rotor 20 and the outer rotor 30 are rotatably housed. The body member 50 is formed from a metal such as iron or aluminum. The body member 50 is a molded article formed by pressing, heading, or die casting, or a workpiece further subjected to cutting or polishing.

Figure 8:
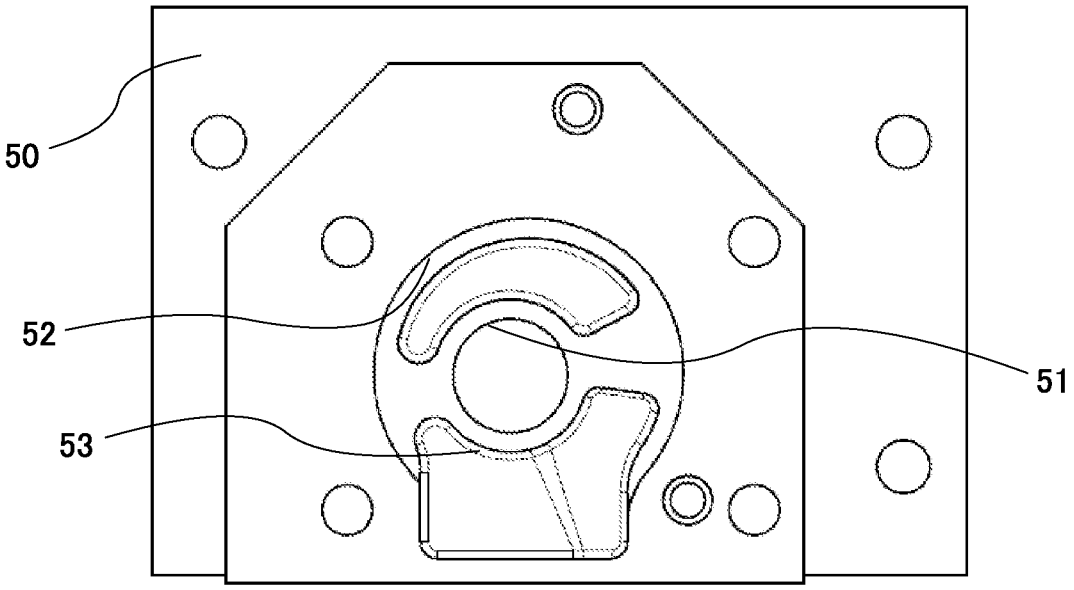
FIG. 8 is a back view of a body member included in the oil pump according to the embodiment.

As shown in FIG. 5, FIG. 7, and FIG. 8, the body member 50 has a shaft hole 51 and a housing chamber 52. The shaft hole 51 is a through hole through which the shaft member 10 is inserted. The shaft member 10 is supported so as to be rotatable relative to the body member 50. The housing chamber 52 is a substantially columnar space in which the inner rotor 20 and the outer rotor 30 are rotatably housed. The housing chamber 52 is formed in a recess shape so as to be surrounded by a bottom wall 52*a* and a side wall 52*b*.

The side opposite to the bottom wall 52*a* side in the axial direction in the housing chamber 52 is open. The inner rotor 20 and the outer rotor 30 are inserted into the housing chamber 52 from the opening side of the housing chamber 52 when assembling the inner rotor 20 and the outer rotor 30 to the body member 50. The inner rotor 20 rotates integrally as the shaft member 10 rotates. In addition, the outer rotor 30 rotates relative to the body member 50 as the inner rotor 20 rotates.

The cover member 60 is a member that covers the opening of the housing chamber 52. The cover member 60 is attached so as to close the housing chamber 52. The cover member 60 is formed from a thermoplastic resin or the like. The resin for forming the cover member 60 preferably has excellent creep resistance, load resistance, wear resistance, etc., and is, for example, a polyphenylene sulfide (PPS) resin, a thermoplastic polyimide resin, or the like. The cover member 60 is formed by injection molding or the like.

Figure 9:
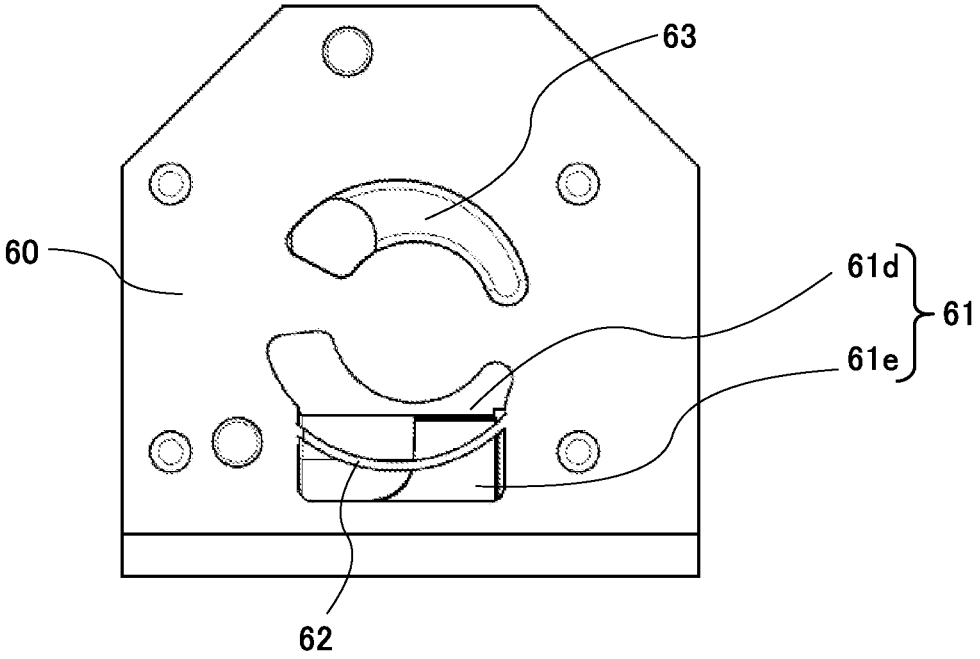
FIG. 9 is a front view of a cover member included in the oil pump according to the embodiment.

As shown in FIG. 5, FIG. 6, and FIG. 9, the cover member 60 has a suction path 61. The suction path 61 has an inlet 61*a* which is open on an oil pan (not shown) side, and an outlet 61*b* which is open on the rotor chambers 40 side. The suction path 61 is a passage in which the oil introduced from the oil pan side into the inlet 61*a* and sucked via the outlet 61*b* into the rotor chamber 40 flows. The inlet 61*a* and the outlet 61*b* are provided such that the openings thereof are formed in surfaces orthogonal to each other. For example, as shown in FIG. 5, the inlet 61*a* is formed in the lower surface of the cover member 60, and the outlet 61*b* is formed in the side surface of the cover member 60.

The strainer 70 is attached to the inlet 61*a* side of the suction path 61 by bolting or the like. The strainer 70 removes impurities from the oil sucked up from the oil pan via a suction port 71. The oil from which the impurities have been removed by the strainer 70 is guided to the suction path 61.

The suction path 61 has a main path 61*c*, a first branch path 61*d*, and a second branch path 61*e*. The main path 61*c* includes the inlet 61*a* and is provided on the upstream side of the suction path 61. The first branch path 61*d* and the second branch path 61*e* each include the outlet 61*b* and are provided on the downstream side of the suction path 61. The main path 61*c* communicates with the first branch path 61*d* and also communicates with the second branch path 61*e*. The outlet 61*b* has a first outlet 61*b*-1 which is open on the first branch path 61*d* side, and a second outlet 61*b*-2 which is open on the second branch path 61*e* side.

The cover member 60 has a straightening member 62. The straightening member 62 is a member that branches the suction path 61 from the main path 61*c* to the first branch path 61*d* and the second branch path 61*e*. The straightening member 62 divides the downstream side of the suction path 61 into the first branch path 61*d* and the second branch path 61*e*, and divides the outlet 61*b* into the first outlet 61*b*-1 and the second outlet 61*b*-2. The straightening member 62 straightens the oil flowing from the main path 61*c* to the first branch path 61*d* and the oil flowing from the main path 61*c* to the second branch path 61*e*.

The straightening member 62 is formed in a plate shape. The straightening member 62 is integrally provided to the cover member 60. The straightening member 62 may be a member that is formed separately from the cover member 60 and that is attached to the cover member 60 after the formation (for example, a member that is fitted into a recess groove provided on the cover member 60). The straightening member 62 is disposed near the outlet 61*b*. The straightening member 62 extends parallel to a surface, of the cover member 60, in which the inlet 61*a* is formed, and also extends in a direction orthogonal to a surface, of the cover member 60, in which the outlet 61*b* is formed. The oil that has entered the suction path 61 from the strainer 70 flows through the main path 61*c*, and then branches and flows through the first branch path 61*d* and the second branch path 61*e* which are branched by the straightening member 62.

The first branch path 61*d* communicates with the rotor chambers 40 side at the first outlet 61*b*-1. The oil that has entered the first branch path 61*d* from the main path 61*c* is guided from the first outlet 61*b*-1 to the rotor chambers 40.

The body member 50 has a suction path 53. The suction path 53 has an inlet 53*a* which is open on the suction path 61 (specifically, the second branch path 61*e*) side of the cover member 60, and an outlet 53*b* which is open on the rotor chambers 40 side. The suction path 53 is formed so as to communicate with the rotor chambers 40 in a state where the inner rotor 20 and the outer rotor 30 are housed in the housing chamber 52 of the body member 50. The suction path 53 communicates with the second branch path 61*e* of the suction path 61 of the cover member 60 at the inlet 53*a*, and also communicates with the rotor chambers 40 at the outlet 53*b*. The suction path 53 is a passage in which the oil introduced from the second outlet 61*b*-2 of the second branch path 61*e* into the inlet 53*a* and sucked via the outlet 53*b* into the rotor chambers 40 flows.

The suction path 53 is formed in a space other than a region occupied radially inward of the outer circumferential surface of the outer rotor 30 in a state where the outer rotor 30 is housed, in the entire housing chamber 52 of the body member 50. That is, the housing chamber 52 includes the region occupied radially inward of the outer circumferential surface of the outer rotor 30 in a state where the outer rotor 30 is housed, and a region occupied by the suction path 53 in a state where the outer rotor 30 is housed. The suction path 53 includes an upstream space which is connected to the inlet 53*a* and is formed radially outward of the outer rotor 30 housed in the housing chamber 52, and a downstream space which is connected to the outlet 53*b* and is formed on the back side opposite to the opening side of the housing chamber 52 in the axial direction with respect to the outer rotor 30.

The second branch path 61*e* communicates with the inlet 53*a* of the suction path 53 at the second outlet 61*b*-2. Furthermore, the suction path 53 communicates with the rotor chambers 40 at the outlet 53*b*. The oil that has entered the second branch path 61*e* from the main path 61*c* is guided from the second outlet 61*b*-2 to the suction path 53, then flows through the suction path 53, and is guided to the rotor chambers 40.

Each rotor chamber 40 has a first suction port 41 and a second suction port 42. The first suction port 41 and the second suction port 42 are each a port through which the oil guided from the suction path 61 side of the cover member 60 to the rotor chamber 40 passes. The first suction port 41 and the second suction port 42 are provided at positions between which the rotor chambers 40 are located in the axial direction, and are provided on both sides in the axial direction of the rotor chamber 40 so as to be opposed to each other in the axial direction.

When one axial end face (right end face in FIG. 5) of the rotor chamber 40 is exposed to the first branch path 61*d* of the suction path 61, the exposed portion thereof becomes the first suction port 41, and when the other axial end face (left end face in FIG. 5) of the rotor chamber 40 is exposed to the suction path 53, the exposed portion thereof becomes the second suction port 42.

The first suction port 41 communicates with the first outlet 61*b*-1 of the first branch path 61*d*. The second suction port 42 communicates with the outlet 53*b* of the suction path 53. The oil guided from the main path 61*c* to the first branch path 61*d* is sucked through the first suction port 41 into the rotor chamber 40, and the oil entering the second branch path 61*e* from the main path 61*c* and guided to the suction path 53 is sucked through the second suction port 42 into the rotor chamber 40.

The straightening member 62 straightens the oil guided from the main path 61*c* of the suction path 61 to the first branch path 61*d* and guided to the first suction port 41 of the rotor chamber 40, and the oil guided from the main path 61*c* to the second branch path 61*e* and the suction path 53 and guided to the second suction port 42 of the rotor chamber 40. Specifically, the straightening member 62 is formed and disposed such that the flow velocity (referred to as first flow velocity) of the oil guided to the first suction port 41 and the flow velocity (referred to as second flow velocity) of the oil guided to the second suction port 42 are equal to each other.

The straightening member 62 demarcates the first branch path 61*d* and the second branch path 61*e* such that the cross-sectional areas thereof are equal to each other. That is, the first branch path 61*d* and the second branch path 61*e* are formed such that the cross-sectional areas thereof are equal to each other.

The above oil flow velocities or the above branch path cross-sectional areas being "equal" to each other is not limited to exact equality, but may include those that can be equated with each other. For example, a range where there is no ununiformity between the flow rates of the oil flowing through the first branch path 61*d* and the second branch path 61*e* and cavitation is unlikely to occur is included in the range of being "equal".

The straightening member 62 is formed in a plate shape as described above. The straightening member 62 is formed and disposed such that one axial end face (right end face in FIG. 5) thereof faces the suction path 61 and the other axial end face (left end face in FIG. 5) thereof is opposed to the axial end face of the outer rotor 30 in the axial direction without interruption from one end to the other end thereof in a direction different from the thickness direction of the straightening member 62. The other axial end face of the straightening member 62 is constantly opposed to the axial end face of the outer rotor 30 even when the outer rotor 30 rotates about the axis.

That is, the straightening member 62 is formed and disposed such that: the radial position of a line segment along which the other axial end face of the straightening member 62 intersects a surface, of the straightening member 62, which faces the radially outer side is located radially outward of the radial position of a maximum inner edge portion having the largest inner diameter (maximum inner diameter) of the inner edge of the outer rotor 30 over the entire range of the line segment; and the radial position of a line segment along which the other axial end face of the straightening member 62 intersects a surface, of the straightening member 62, which faces the radially inner side is located radially inward of the radial position of the outer edge of the outer rotor 30 over the entire range of the line segment.

The straightening member 62 may have a thickness equal to or smaller than the radial width between the outer edge and the above maximum inner edge portion of the outer rotor 30. In this case, the other axial end face of the straightening member 62 is opposed to the axial end face of the outer rotor 30 within a range from the outer edge of the outer rotor 30 to a portion radially inward therefrom by the above radial width.

The straightening member 62 is formed so as to be curved along the outer shape of the outer rotor 30. Specifically, the straightening member 62 is formed so as to extend in an arc shape around the axial center of the shaft member 10.

The straightening member 62 is formed such that the above other axial end face thereof is flush with the surface, of the cover member 60, in which the outlet 61*b* of the suction path 61 is formed. As will be described later, the plate member 80 is interposed between the body member 50 and the cover member 60. The straightening member 62 is formed and disposed such that a gap 90 is formed between the other axial end face thereof and the axial end face of the outer rotor 30. In order to prevent the oil from entering and exiting between the first branch path 61*d* and the second branch path 61*e*, it is more preferable if the gap 90 is smaller, and it is further preferable if no gap 90 is formed. The size of the gap 90 is set so as to be equal to or smaller than a maximum size (for example, 2 mm) that allows the oil to be prevented from entering and exiting between the first branch path 61*d* and the second branch path 61*e*.

The cover member 60 also has a discharge path 63. The discharge path 63 has an inlet 63*a* which is open on the rotor chambers 40 side, and an outlet 63*b* (see FIG. 3) which is open on the oil supply target side. The discharge path 63 is a passage in which the oil discharged from the rotor chamber 40 and entering through the inlet 63*a* flows toward the outlet 63*b*. The oil flowing through the discharge path 63 and discharged from the outlet 63*b* is supplied to the oil supply target.

Figure 11:
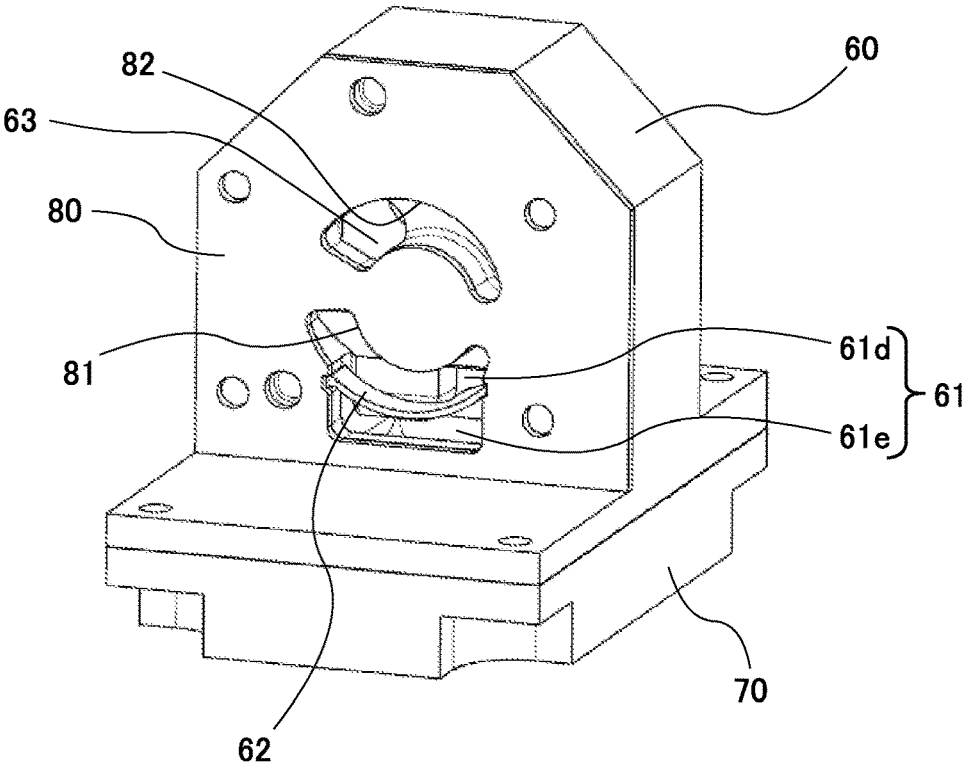
FIG. 11 is a perspective view showing a state where a plate member is assembled to the cover member included in the oil pump according to the embodiment.

The plate member 80 is a plate-shaped member interposed between the body member 50 and the cover member 60. The plate member 80 serves as a partition so as to close the opening of the housing chamber 52 of the body member 50. The plate member 80 is provided in order to increase the pressures of the rotor chambers 40 to a predetermined high-pressure state. Similar to the body member 50, the plate member 80 is formed from metal such as iron or aluminum. As shown in FIG. 6, FIG. 7, and FIG. 11, the plate member 80 has a suction hole 81 and a discharge hole 82.

The suction hole 81 is a through hole that guides the oil from the suction path 61 of the cover member 60 to the rotor chambers 40. In a state of being interposed between the body member 50 and the cover member 60, the suction hole 81 communicates with the first outlet 61*b*-1 of the first branch path 61*d* of the suction path 61 and the first suction ports 41 of the rotor chambers 40, and communicates with the second outlet 61*b*-2 of the second branch path 61*e* of the suction path 61 and the inlet 53*a* of the suction path 53 of the body member 50.

The suction hole 81 is formed in a shape that matches the shape of the outlet 61*b* of the suction path 61. A part (specifically, the part communicating with the first branch path 61*d* and the rotor chambers 40) of the suction hole 81 is formed so as to extend in an arc shape around the axial center of the shaft member 10. The other part (specifically, the part communicating with the second branch path 61*e* and the suction path 53 of the body member 50) of the suction hole 81 is formed so as to be continuous with the above part of the suction hole 81. As a whole, the suction path 61 (specifically, the main path 61*c*, the first branch path 61*d*, and the second branch path 61*e*), the suction hole 81, and the suction path 53 form a suction passage (hereinafter, collectively referred to as suction passage 43 as appropriate) for suctioning the oil into the rotor chambers 40.

Moreover, the discharge hole 82 is a through hole that guides the oil from the rotor chambers 40 to the discharge path 63 of the cover member 60. In a state of being interposed between the body member 50 and the cover member 60, the discharge hole 82 communicates with the rotor chambers 40 and the discharge path 63. The discharge hole 82 is formed in a shape that matches the shape of the inlet 63*a* of the discharge path 63. The discharge hole 82 is formed so as to extend in an arc shape around the axial center of the shaft member 10. As a whole, the discharge hole 82 and the discharge path 63 form a discharge passage (hereinafter, collectively referred to as discharge passage 44 as appropriate) for supplying the oil discharged from the rotor chambers 40, to the oil supply target.

The body member 50, the plate member 80, and the cover member 60 are fastened to each other by bolting or the like in a state where the shaft member 10 is rotatably supported on the body member 50 and the inner rotor 20 and the outer rotor 30 are housed in the housing chamber 52 of the body member 50. In addition, the body member 50 is fixed to a structure (not shown) of the vehicle by bolting or the like.

Next, the operation of the oil pump 1 will be described.

In the oil pump 1, when the shaft member 10 rotates, the inner rotor 20 rotates relative to the body member 50 in accordance with the rotation of the shaft member 10, and the outer rotor 30 rotates relative to the body member 50 in accordance with the rotation of the inner rotor 20.

During rotation of the inner rotor 20 and the outer rotor 30 forming the trochoid pump, in a process in which the volume of the rotor chamber 40 increases, the internal pressure of the rotor chamber 40 becomes negative. At the timing at which the internal pressure of the rotor chamber 40 becomes negative, the rotor chamber 40 provides communication with the suction passage 43. When such communication is provided, the oil is sucked up from the oil pan, passes through the strainer 70, flows through the main path 61*c* of the suction path 61, then branches and flows through: a path through which the oil flows through the first branch path 61*d* and the suction hole 81 and is sucked into the rotor chamber 40 via the first suction port 41; and a path through which the oil flows through the second branch path 61*e*, the suction hole 81, and the suction path 53 and is sucked into the rotor chamber 40 via the second suction port 42, and is sucked into the rotor chamber 40.

Moreover, during rotation of the inner rotor 20 and the outer rotor 30, in a process in which the volume of the rotor chamber 40 decreases, the internal pressure of the rotor chamber 40 rises. At the timing at which the internal pressure of the rotor chamber 40 rises, the rotor chamber 40 provides communication with the discharge passage 44. When such communication is provided, the oil in the rotor chamber 40 is discharged via the discharge hole 82 to the discharge path 63, and supplied from the outlet 63*b* toward the oil supply target.

When the above pumping action is continuously performed by the rotation of the inner rotor 20 and the outer rotor 30, the oil pump 1 pressure-feeds the oil toward the oil supply target while sucking up the oil from the oil pan. Therefore, with the oil pump 1, it is possible to pressure-feed the oil sucked up from the oil pan, toward the oil supply target.

Moreover, in the oil pump 1, each rotor chamber 40 has the two suction ports 41 and 42, and the oil to be sucked from the suction path 61 side into the rotor chamber 40 passes through the two suction ports 41 and 42. Specifically, a part of the oil flowing through the main path 61*c* is guided to the first suction port 41 through a path including the first branch path 61*d*, and the rest of the oil is guided to the second suction port 42 through a path including the second branch path 61*e* and the suction path 53.

With the configuration of the oil pump 1, it is possible to suck the oil through the two suction ports 41 and 42 into the rotor chamber 40 surrounded by the outer circumferential surface of the inner rotor 20 and the inner peripheral surface of the outer rotor 30. In particular, the two suction ports 41 and 42 are opposed to each other in the axial direction on both sides in the axial direction of the rotor chamber 40. Therefore, the maximum flow rate of the oil sucked into the rotor chamber 40 can be ensured without increasing the size of the rotor chamber 40 such that the rotor chamber 40 protrudes to the radially outer side. Therefore, it is possible to realize the oil pump 1 having a small size and high performance.

Moreover, in the oil pump 1, the straightening member 62 is provided so as to branch the suction passage 43 to the first suction port 41 side and the second suction port 42 side. The straightening member 62 straightens the oil guided from the suction passage 43 to the first suction port 41 of the rotor chamber 40 and the oil guided from the suction passage 43 to the second suction port 42 of the rotor chamber 40. With this configuration, it is possible to inhibit the flow rate of the oil guided from the suction passage 43 to the rotor chamber 40 from being ununiform in that the flow rate of the oil via one suction port 41 or 42 side out of the two suction ports 41 and 42 is higher.

In particular, the straightening member 62 is formed and disposed such that the first flow velocity of the oil guided to the first suction port 41 and the second flow velocity of the oil guided to the second suction port 42 are equal to each other, and demarcates the two branch paths 61*d* and 61*e*, which are branched from the main path 61*c* of the suction path 61, such that the cross-sectional areas of the branch paths 61*d* and 61*e* are equal to each other. With this configuration, it is possible to make the flow rate of the oil guided from the main path 61*c* of the suction passage 43 to the two branch paths 61*d* and 61*e* to be substantially uniform, thereby making the suction of the oil into the rotor chamber 40 via the two suction ports 41 and 42 to be substantially uniform.

Therefore, with the configuration of the oil pump 1, it is possible to suppress occurrence of a difference between the flow velocities of the oil introduced via the two suction ports 41 and 42, thereby reducing the pressure difference between the two suction ports 41 and 42. Accordingly, it is possible to suppress occurrence of cavitation which causes erosion.

Moreover, the straightening member 62 is formed and disposed such that the other axial end face of the straightening member 62 is opposed to the axial end face of the outer rotor 30 in the axial direction without interruption from one end to the other end thereof in a direction (specifically, the circumferential direction) different from the thickness direction of the straightening member 62.

With the configuration of the oil pump 1, since a situation in which the other axial end face of the straightening member 62 is located radially outward of the outer edge of the outer rotor 30 over the entire range in the thickness direction thereof at least at a part from one end to the other end in the circumferential direction does not occur, it is possible to prevent the first branch path 61*d* from directly communicating with the suction path 53 of the body member 50. In addition, since a situation in which the other axial end face of the straightening member 62 faces the rotor chamber 40 over the entire range in the thickness direction thereof at least at a part from one end to the other end in a direction different from the thickness direction of the straightening member 62 does not occur, it is possible to prevent the second branch path 61*e* from directly communicating with the first suction port 41.

Therefore, it is possible to prevent the oil that has once branched to the first branch path 61*d* side and the second branch path 61*e* side on one axial end side of the straightening member 62, from being sucked into the suction port 42 or 41 different from the desired suction port 41 or 42 of the rotor chamber 40 on the other axial end side of the straightening member 62.

The straightening member 62 is formed such that the other axial end face of the straightening member 62 is flush with the surface, of the cover member 60, in which the outlet 61*b* of the suction path 61 is formed, and is also formed and disposed such that the gap 90 is formed between the other axial end face of the straightening member 62 and the axial end face of the outer rotor 30. The size of the gap 90 is set to a size that allows the oil to be prevented from entering and exiting between the first branch path 61*d* and the second branch path 61*e*. Therefore, in the configuration of the oil pump 1, it is possible to prevent the oil that has once branched to the first branch path 61*d* side and the second branch path 61*e* side on one axial end side of the straightening member 62, from being sucked into the suction port 42 or 41 different from the desired suction port 41 or 42 of the rotor chamber 40 via the gap 90 on the other axial end side of the straightening member 62.

Moreover, the above straightening member 62 is formed so as to be curved along the outer shape of the outer rotor 30. In this configuration, it is possible to enlarge the region where the first branch path 61*d* and the rotor chambers 40 communicate with each other, and the region where the second branch path 61*e* and the suction path 53 communicate with each other, in the direction around the axis of the shaft member 10. Therefore, it is possible to increase the flow path cross-sectional area of the suction passage 43, thereby increasing the maximum flow rate of the oil sucked from the suction passage 43 into the rotor chamber 40.

As described above, the oil pump 1 has a structure in which the straightening member 62 is formed and disposed such that the other axial end face of the straightening member 62 is opposed to the axial end face of the outer rotor 30 in the axial direction without interruption from one end to the other end thereof in the circumferential direction, and is also formed so as to be curved along the outer shape of the outer rotor 30. With this structure, it is possible to increase the maximum flow rate of the oil sucked from the suction passage 43 into the rotor chamber 40, while preventing the oil that has branched to the first branch path 61*d* side and the second branch path 61*e* side, from joining with the other branch path 61*e* or 61*d* side and being sucked into the suction port 42 or 41 different from the desired suction port 41 or 42.

Meanwhile, in the above embodiment, the straightening member 62 is formed such that the other axial end face of the straightening member 62 is flush with the surface, of the cover member 60, in which the outlet 61*b* of the suction path 61 is formed, and is also formed and disposed such that the gap 90 is formed between the other axial end face of the straightening member 62 and the axial end face of the outer rotor 30. However, the present invention is not limited thereto, and the straightening member 62 may be formed such that the other axial end face of the straightening member 62 protrudes from the surface, of the cover member 60, in which the outlet 61*b* of the suction path 61 is formed, to the body member 50 side, and may be formed and disposed such that no gap 90 is formed between the other axial end face of the straightening member 62 and the axial end face of the outer rotor 30. With the configuration of this modification, it is possible to reliably prevent the oil that has branched to the first branch path 61*d* side and the second branch path 61*e* side, from joining with the other branch path 61*e* or 61*d* side and being sucked into the suction port 42 or 41 different from the desired suction port 41 or 42.

Moreover, in the above embodiment, the straightening member 62 which branches the main path 61*c* of the cover member 60 to the first branch path 61*d* and the second branch path 61*e* is integrally provided to the cover member 60. However, the present invention is not limited thereto, and a straightening member which branches the main path 61*c* of the cover member 60 to the first branch path 61*d* and the second branch path 61*e* may be provided as a member separate from the cover member 60. For example, the straightening member may be provided to the plate member 80. In this modification, the straightening member may be formed so as to protrude from a plate surface of the plate-shaped plate member 80 into the suction path 61 to demarcate the first branch path 61*d* and the second branch path 61*e*.

The present invention is not limited to the embodiments and modifications described above, and various changes may be made without departing from the gist of the present invention.

This application claims priority on Japanese Patent Application No. 2021-089642 filed in Japan on May 27, 2021, the entire contents of which are incorporated herein by reference.

The invention claimed is:

1. An oil pump comprising:

a shaft member configured to rotate by drive of a drive source;

an inner rotor having external teeth and configured to rotate integrally with the shaft member;

an outer rotor having internal teeth meshing with the external teeth, configured to rotate as the inner rotor rotates, and forming a rotor chamber into which oil is sucked from a suction passage and from which the oil is discharged toward a discharge passage, between the inner rotor and the outer rotor;

a body member having a recess-shaped housing chamber in which the inner rotor and the outer rotor are housed so as to be rotatable about an axis; and a cover member having at least a part of the suction passage and attached so as to close the housing chamber, wherein the rotor chamber has a first suction port and a second suction port through each of which the oil to be sucked from the suction passage into the rotor chamber passes, and the oil pump comprises a straightening member branching the suction passage from a main path to the first suction port and the second suction port, and configured to straighten the oil guided from the main path to the first suction port and the oil guided from the main path to the second suction port, wherein the straightening member is formed and disposed such that an axial end face of the straightening member is opposed to an axial end face of the outer rotor in an axial direction without interruption from one end to another end thereof in a direction different from a thickness direction of the straightening member.

2. The oil pump according to claim 1, wherein the straightening member is formed and disposed such that a first flow velocity of the oil guided from the main path to the first suction port and a second flow velocity of the oil guided from the main path to the second suction port are equal to each other.

3. The oil pump according to claim 1, wherein the first suction port and the second suction port are provided at both ends in an axial direction of the rotor chamber so as to be opposed to each other in the axial direction, the cover member has a first branch path provided on a downstream side of the main path, communicating with an exit of the main path, and configured to guide the oil to the first suction port, and a second branch path provided on the downstream side of the main path, communicating with the exit of the main path, and configured to guide the oil to the second suction port, and the body member has a suction path communicating with the second branch path and configured to guide the oil to the second suction port.

4. The oil pump according to claim 3, wherein the straightening member demarcates the first branch path and the second branch path such that cross-sectional areas thereof are equal to each other.

5. The oil pump according to claim 1, wherein the straightening member is formed so as to be curved along an outer shape of the outer rotor.

6. The oil pump according to claim 1, wherein the straightening member is formed and disposed such that a gap of 2 mm or less is formed between the axial end face of the straightening member and the axial end face of the outer rotor.

7. The oil pump according to claim 1, wherein the straightening member is integrally provided to the cover member.

* * * * *